US008646861B2

(12) United States Patent
Nagamura et al.

(10) Patent No.: US 8,646,861 B2
(45) Date of Patent: Feb. 11, 2014

(54) PRINTING APPARATUS, PRINTING SYSTEM, AND CONTROL METHOD FOR THE SAME SYSTEM

(75) Inventors: Mitsutoshi Nagamura, Tokyo (JP); Akihiro Kakinuma, Hadano (JP); Daigoro Kanematsu, Yokohama (JP); Naoko Baba, Kawasaki (JP); Asako Watanabe, Kawasaki (JP); Akihiro Tomida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 268 days.

(21) Appl. No.: 12/170,569

(22) Filed: Jul. 10, 2008

(65) Prior Publication Data

US 2009/0015610 A1 Jan. 15, 2009

(30) Foreign Application Priority Data

Jul. 13, 2007 (JP) ..... 2007-184497

(51) Int. Cl.
*B41J 25/308* (2006.01)

(52) U.S. Cl.
USPC ..... 347/8; 347/9; 347/19

(58) Field of Classification Search
USPC ..... 347/5, 8, 9, 19, 14, 41, 15
See application file for complete search history.

(56) References Cited

U.S. PATENT DOCUMENTS

| | | | | |
|---|---|---|---|---|
| 6,164,756 | A | 12/2000 | Takahashi et al. | |
| 6,273,536 | B1 * | 8/2001 | Nozawa | 347/8 |
| 6,517,192 | B2 | 2/2003 | Kaneko et al. | |
| 7,175,246 | B2 * | 2/2007 | Niekawa et al. | 347/14 |

FOREIGN PATENT DOCUMENTS

| | | | |
|---|---|---|---|
| JP | 2002-127399 | A | 5/2002 |
| JP | 2002-292856 | A | 10/2002 |
| JP | 2006-102987 | A | 4/2006 |
| JP | 2006-103278 | A | 4/2006 |

OTHER PUBLICATIONS

Japanese Office Action issued in corresponding application 2008-181415 on Oct. 31, 2012—4 pages

* cited by examiner

*Primary Examiner* — Lam S Nguyen
(74) *Attorney, Agent, or Firm* — Fitzpatrick, Cella, Harper & Scinto

(57) ABSTRACT

The optimal number of print passes and a head-to-platen distance are set according to a content of an image to be printed and the user's request (emphasis is put on quality or speed, etc.) to thereby appropriately meet the needs for higher image quality and higher productivity and to perform printing with high reliability. To this end, it is made possible to select whether to execute processing for issuing an instruction to set the number of print passes and the head-to-platen distance according to discrimination of the content of the image. When the execution of the processing is selected, the number of print passes and the head-to-platen distance are appropriately set according to the content of the image (duty, etc.). Meanwhile, when it is not selected, the image is printed by one-pass print with the head-to-platen distance set larger, regardless of the content of the image.

17 Claims, 13 Drawing Sheets

| | |
|---|---|
| K[0] | FOR REFERENCE AREA RATIO |
| K[1] | FOR DRAW COMMAND 1 |
| K[2] | FOR DRAW COMMAND 2 |
| . | . |
| K[n] | FOR DRAW COMMAND n |

FIG.8

| | |
|---|---|
| T[0] | TOTAL AREA |
| T[1] | FOR DRAW COMMAND 1 |
| T[2] | FOR DRAW COMMAND 2 |
| . | . |
| T[n] | FOR DRAW COMMAND n |

FIG.11

| PRINT METHOD | PRINT PASS NUMBER | HEAD-TO-PAPER DISTANCE |
|---|---|---|
| PRINT METHOD 1 | ONE PASS | 1.3mm |
| PRINT METHOD 2 | TWO PASSES | 1.9mm |
| PRINT METHOD 3 | ONE PASS | 1.9mm |

FIG.12

ENVIRONMENTAL CONDITION A TEMPERATURE: 15℃~30℃ HUMIDITY: 40%~60%

| PRINT METHOD | PRINT PASS NUMBER | HEAD-TO-PAPER DISTANCE |
|---|---|---|
| PRINT METHOD 1 | ONE PASS | 1.3mm |
| PRINT METHOD 2 | TWO PASSES | 1.9mm |
| PRINT METHOD 3 | ONE PASS | 1.9mm |

FIG.13A

ENVIRONMENTAL CONDITION B TEMPERATURE: 15℃~30℃ HUMIDITY: 10%~40%

| PRINT METHOD | PRINT PASS NUMBER | HEAD-TO-PAPER DISTANCE |
|---|---|---|
| PRINT METHOD 1 | ONE PASS | 1.7mm |
| PRINT METHOD 2 | TWO PASSES | 2.1mm |
| PRINT METHOD 3 | ONE PASS | 2.1mm |

FIG.13B

PRINTING APPARATUS, PRINTING SYSTEM, AND CONTROL METHOD FOR THE SAME SYSTEM

BACKGROUND OF THE INVENTION

1. Field of the Invention

The present invention relates to an inkjet printing apparatus and a printing system each using a printing head that ejects ink to perform printing, and a control method for the same system.

2. Description of the Related Art

In general, the inkjet printing apparatus includes a carriage on which a printing head as a printing unit and an ink tank are mounted, a conveying unit that conveys, for example, printing paper as a printing medium, and a control unit for controlling the drive of the carriage and conveying unit. The inkjet printing apparatus moves the carriage on which the printing head is mounted in a direction intersecting a conveying direction of the printing medium. In the course of this movement, a plurality of ink ejection openings of the printing head eject ink. When this movement is completed, the printing medium is conveyed by a predetermined amount. Movement of the printing head and conveyance of the printing medium are alternately repeated to thereby perform printing on the entire printing medium.

In the aforementioned inkjet printing apparatus, there is an important relationship between the printing medium and the amount of ink applied thereto. For example, when a large amount of ink is ejected onto the printing medium such as platen at one time, swelling occurs, with the result that waving of the printing medium, which is called cockling, is generated. When such cockling is severe, the printing medium and the printing head may come into contact with each other, and thus be fouled.

In order to avoid this problem, it is considered that a distance between a printing surface of the printing medium and the printing head is sufficiently ensured in advance to prevent the printing medium from coming into contact with the printing head even when cockling occurs. However, the inkjet printing apparatus performs printing by ejecting ink while moving the printing head with respect to the printing medium. Thus, when the above distance is too large, the accuracy of dot-landing positions on the printing medium is reduced, making dot-forming positions unstable, which results in a decrease in image quality. For this reason, conversely, it is desirable that the above distance be small in view of improvement of the image quality.

In order to solve the problem of contact between the printing medium and the printing head caused by deflection of the printing medium due to cockling, a configuration is proposed in which a distance between a printing head and a platen for supporting the printing head, the distance being referred as 'head-to-platen distance' hereinafter, is adjusted to change a distance between a surface of a printing medium to be printed and the printing head according to duty of an image (see Japanese Patent Laid-Open No. 2002-292856). In this proposal, in the case of a high duty where there is a high possibility that cockling will occur, the head-to-platen distance is set large, while in the case of a low duty where there is a low possibility that cockling will occur, the head-to-platen distance is set small. According to this configuration, it is possible to suppress head rubbing and to achieve higher image quality.

However, in the case of the configuration in Japanese Patent Laid-Open No. 2002-292856, determination processing for determining the content of the image (duty) must be carried out for every image output, so that correspondingly longer time is required for image output. The configuration in Japanese Patent Laid-Open No. 2002-292856 is insufficient for users who put emphasis on speed rather than image quality. Thus, Japanese Patent Laid-Open No. 2002-292856 cannot meet various user needs (for example, emphasis is put on quality or speed, or the like).

SUMMARY OF THE INVENTION

In view of the aforementioned circumstances, it is an object of the present invention to enable an optimal head-to-platen distance to be set according to the content of an image to be printed and the user's request, thereby making it possible to appropriately meet the needs for higher image quality and higher productivity.

In a first aspect of the present invention, there is provided a printing apparatus that performs an operation for moving a printing head for ejecting ink to a printing medium and an operation for conveying the printing medium in a direction intersecting a direction of a movement of the printing head to thereby print an image on the printing medium, the printing apparatus comprising:

a platen that supports the printing medium conveyed; and a setting unit that sets a distance between the printing head and the platen according to a selection result of whether or not to execute discrimination processing for discriminating a content of an image to be printed, wherein when the execution of the discrimination processing is selected, the setting unit sets the distance according to the content of the image discriminated by the discrimination processing, and when the execution of the discrimination processing is not selected, the setting unit sets a predetermined distance.

In a second aspect of the present invention, there is provided a printing apparatus that performs an operation for moving a printing head for ejecting ink to a printing medium and an operation for conveying the printing medium in a direction intersecting a direction of movement of the printing head to thereby print an image on the same region on the printing medium, the printing apparatus comprising:

a platen that supports the printing medium conveyed; and a setting unit that sets the number of the movement of the printing medium for the same region and a distance between the printing head and the platen according to a selection result of whether or not to execute discrimination processing for discriminating a content of an image to be printed on the same region, wherein when the execution of the discrimination processing is selected, the setting unit sets the number of the movement of the printing head and the distance according to the content of the image discriminated by the discrimination processing, and when the execution of the discrimination processing is not selected, the setting unit sets a predetermined number of the movement of the printing head and a predetermined distance.

In a third aspect of the present invention, there is provided a printing system that includes the printing apparatus according to claim 1 and a supply apparatus that supplies data of an image to be printed by the printing apparatus, the printing system comprising:

a processing unit that performs the discrimination processing; and a selection unit that selects whether or not to execute the discrimination processing.

In a fourth aspect of the present invention, there is provided a control method for a printing system including the printing apparatus according to claim 1 and a supply apparatus that supplies data of an image to be printed by the printing apparatus, the method comprising:

a processing step of performing the discrimination processing; and a selection step of selecting whether or not to execute the discrimination processing.

In a fifth aspect of the present invention, there is provided a storage medium storing a control program for making a computer as the supply apparatus execute the above control method.

According to the present invention, it is possible to set an optimal head-to-platen distance according to the content of an image to be printed (duty or the like) and user's request. This makes it possible to appropriately meet the needs for higher image quality and higher productivity and to perform printing with high reliability.

Further features of the present invention will become apparent from the following description of exemplary embodiments (with reference to the attached drawings).

BRIEF DESCRIPTION OF THE DRAWINGS

FIG. 8 is an explanatory view showing a configuration example of a coefficient table to be set in the procedure in FIG. 7;

FIG. 11 is an explanatory view showing a configuration example of an area table to be set in the procedure in FIG. 7;

FIG. 12 is an explanatory view showing a configuration example of a print method table to be referenced in the procedure in FIG. 7; and FIGS. 13A and 13B are explanatory views each showing a configuration example of a print method table to be referenced in another embodiment of the present invention.

DESCRIPTION OF THE EMBODIMENTS

The following will specifically explain an embodiment of the present invention with reference to the drawings. It should be noted that this embodiment shows an inkjet printing apparatus capable of performing color printing as a printing apparatus using an inkjet printing system.

Outline of Inkjet Printing Apparatus

Figure 1:
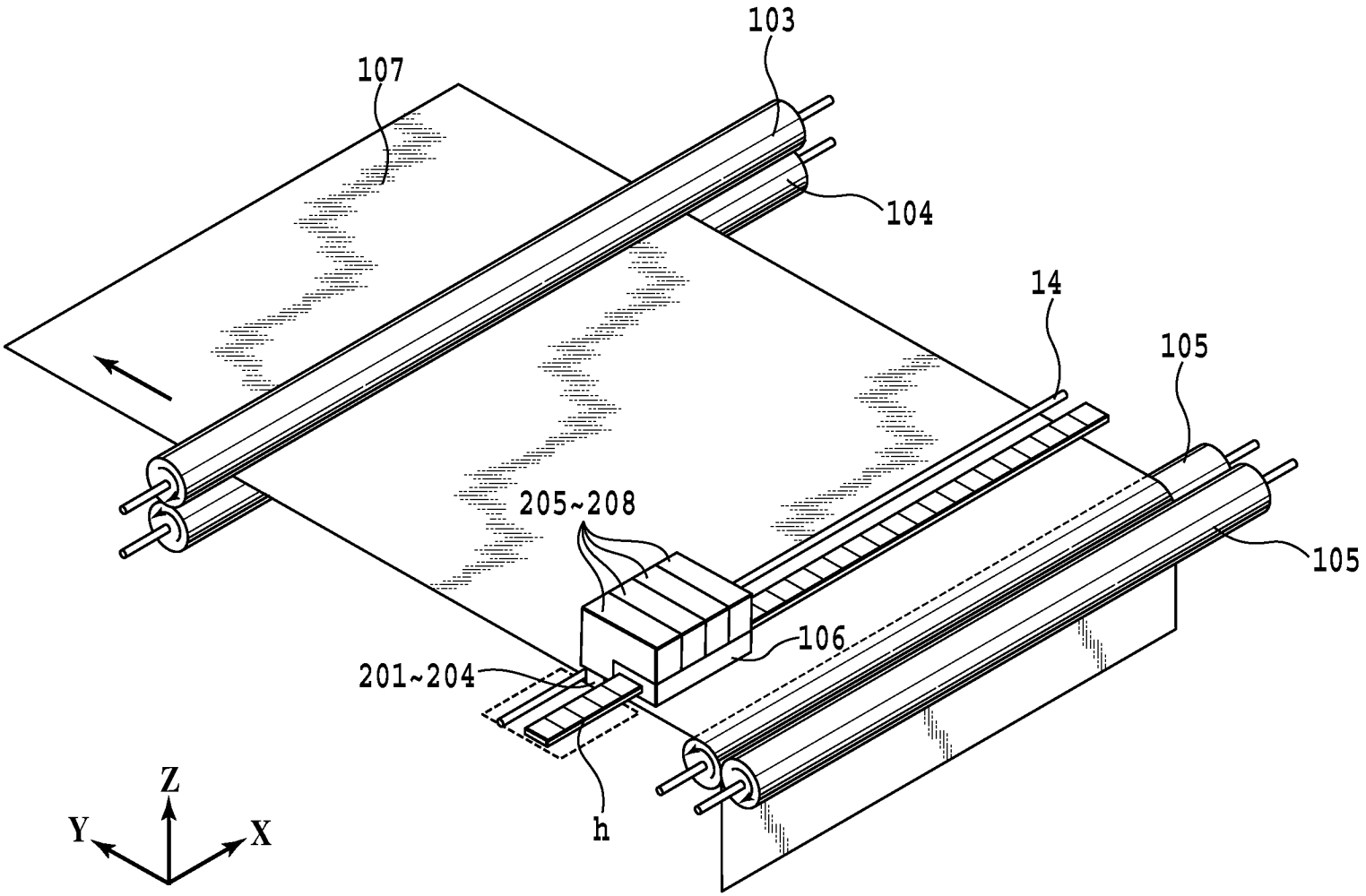
FIG. 1 is a schematic perspective view showing a configuration of one embodiment of a color inkjet printing apparatus to which the present invention can be applied.

FIG. 1 is a schematic perspective view showing a configuration of one embodiment of a color inkjet printing apparatus to which the present invention can be applied. In FIG. 1, reference numerals 205 to 208 denote inkjet cartridges. These cartridges are composed of ink tanks in which inks of four colors, namely, black (K), cyan (C) magenta (M) and yellow (Y) are respectively reserved and printing heads 201 to 204 corresponding to the respective inks.

Reference numeral 106 denotes a carriage that performs reciprocating movement along a guide shaft 14 in an X direction in the figure and a direction opposite thereto while supporting the inkjet cartridges 205 to 208 (this movement is hereinafter referred to as a main scan and the directions of reciprocating movement are referred to as main scanning directions). Reference numeral 103 denotes a conveying roller that rotates in a direction of an arrow in the figure while nipping a printing medium 107 between an auxiliary roller 104 and itself and that intermittently conveys the printing medium 107 in a Y direction (sub-scanning direction) between consecutive main scans. In addition, reference numeral 105 denotes a pair of feed rollers by which the printing medium is fed. Though the pair of rollers 105 rotate with nipping a printing medium P therebetween similarly to the rollers 103 and 104, rotation speed of the rollers 105 is made lower than that of the conveying roller 103 to thereby generate tension on the printing medium, enabling conveyance of the printing medium P without deflection. Incidentally, a platen (not shown in FIG. 1) is disposed to a position facing to ejection opening forming faces (ejection faces) of the printing heads 201 to 204 along a movement range of the printing heads 201 to 204 (see FIGS. 4A and 4B). Accordingly, the printing medium 107 is conveyed by conveying roller 103 in the Y direction while being supported by the platen.

A carriage 106 stands by at a home position h which is shown by a broken line in FIG. 1 when no printing operation is performed by the printing heads 201 to 204 or recovery processing of the printing heads 201 to 204 is performed.

Then, when a print start instruction is issued, the carriage 106, which is placed at the home position h before printing is started, causes ink to be ejected from nozzles of the printing heads 201 to 204 while the main scan is performed in the forward direction (X direction), thus printing a certain bandwidth corresponding to a nozzle array range. When the main scan to a printing medium side end portion is ended, conveyance of the printing medium 107 corresponding to the band width is carried out, while the carriage 106 is returned to the home position h and the main scan is executed again to perform printing in the X direction.

The printing apparatus of this embodiment can execute printing to the same region at one or more scans. For example, the printing apparatus can complete printing for one page, for example, by alternately repeating: printing of one band width with the print heads 201 to 204 while moving the carriage 106 for one main scan; and conveyance of the printing medium by the one band width after the one main scan. In this case, printing on the same printing region (the same region) on the printing medium is completed by one main scan. This type of print mode is called a one-pass print mode.

In contrast to this, in some cases, the printing apparatus performs the main scan multiple times without conveying the printing medium by the one band width after every main scan, and conveys the printing medium only after the multiple times of main scans. Moreover, in some other cases, the printing apparatus completes an image on the same region by performing multiple times of main scans with different nozzles involved in printing and conveying a printing medium multiple times. Specifically, data thinned out by a predetermined mask is printed in every main scan, then the printing medium is conveyed by about a 1/N band width, and thereafter the main scan is performed again. This type of print mode is called a multi-pass print mode.

In order to perform printing on the same region dividedly multiple times (N times) as described above, the same image signal must be supplied to the printing heads dividedly to correspond to N time main scans (note that the signal actually supplied to the printing heads is set to be shifted by the amount corresponding to the amount of sub-scanning). It is a mask that is used to divide the image, and the mask is formed to have a suitable shape, size, and pattern (mask pattern) for applying a distribution state of image data to the image. In many cases, the mask is fixedly stored in a storage unit such as ROM or the like independently of image data, and it is decided by the mask at which scan time of N scan times each nozzle is driven.

The above has shown the case of one direction printing where the printing operation is performed only when the carriage 106 is moved in the forward direction. However, in the case of carrying out high speed printing, it is possible to perform bidirectional printing where the printing operation is also performed when the carriage 106 is moved in the backward direction.

Moreover, the ink cartridges 205 to 208 may be formed so that the printing heads 201 to 204 are separable from their corresponding ink tanks, or integrally formed so that the printing heads 201 to 204 are inseparable from the respective ink tanks. Further, instead of providing the printing head for ink of each color, it may be possible to use a printing head integrally having ejection openings each capable of ejecting ink of each color.

Further, a recovery unit (not shown) can be disposed at the home position h. The recovery unit may have a configuration including a capping unit that caps the ejection face of each of the printing heads 201 to 204, and a pump that exerts a suction force in the cap state to thereby remove thickened ink and bubble in the printing head. Moreover, at the side portion of the capping unit, there is provided a cleaning blade, which is slidably contactable with the ejection face, thereby removing unnecessary ink, dust or the like left on the ejection face after the recovery operation.

Configuration Example of Printing Head

Figure 2:
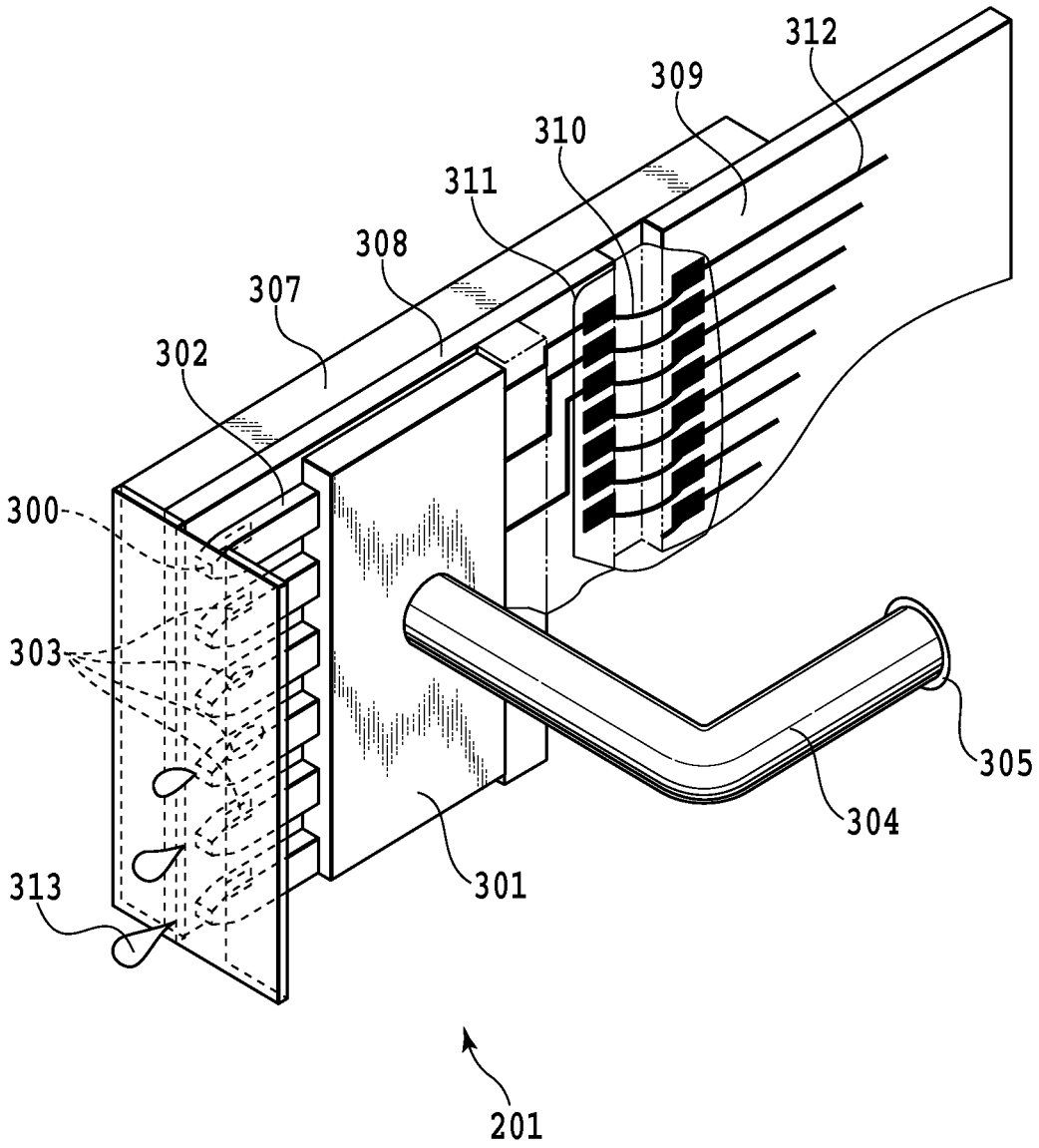
FIG. 2 is a schematic perspective view showing a main part of a printing head applicable to the apparatus in FIG. 1.

FIG. 2 is a schematic perspective view showing a main part of a printing head 201 of printing heads 201 to 204. In addition, the other printing heads 202 to 204 are formed to have basically the same configuration as that of the printing head 201.

As shown in FIG. 2, the printing head 201 is formed to have a plurality of ejection openings 300 arranged with a predetermined pitch. An element 303 for generating energy to be used to eject ink is provided along a wall surface of each liquid passage 302 that connects a common liquid chamber 301 to each ejection opening 300. As the element 303, there can be used an electric thermal transducer element that generates thermal energy which causes a film boiling in the ink in response to energization, and the element including its drive circuit can be formed on a silicon base through semiconductor manufacturing processes such as etching, vacuum evaporation, sputtering, etc. A temperature sensor and a sub-heater (both not illustrated), which are used to perform temperature adjustment of the printing head or ink, are formed on the same silicon base at one time through the same process.

A silicon substrate 308 on which electric thermal transducer elements and electrical wirings therefor are formed is adhered to an Al base plate 307 for heat radiating. Further, a circuit connection section 311 on the silicon substrate 308 and a print board 309 are connected to each other by a wiring 310, and a print signal from the main body of the color inkjet printing apparatus is received through a signal circuit 312.

The common liquid chamber 301 is connected to the ink tank on the above-described inkjet cartridge 205 through a joint pipe 304 and an ink filter 305, and ink is (for example, black ink) contained in the ink tank is supplied to the common liquid chamber 301. Ink temporarily reserved in the common liquid chamber 301 by this supply enters the liquid passage 302 by capillarity to form a meniscus at the ejection openings 300 and to keep the liquid passage 302 filled with ink. At this time, when the electric thermal transducer element 303 is energized and heated through electrodes (not shown), ink thereon is rapidly heated to generate bubble in the liquid passage 302, and an ink droplet 313 is ejected from the ejection opening 300 by expansion of the bubble.

It should be noted that the illustrated printing head is merely by way of example. In other words, the illustrated printing head is provided in the form to eject ink in the same direction as the ink supply direction from the common liquid chamber 301; however, for example, this may be provided in the form to eject ink, for example in a direction perpendicular to the ink supply direction. Further, as an element that generates energy used to eject ink, one that generates mechanical energy such as a piezoelectric element or the like may be used.

Configuration Example of Head-to-Platen Distance Adjusting Mechanism

The printing apparatus of this embodiment is basically configured to be capable of adjusting the head-to-platen distance.

Figure 3:
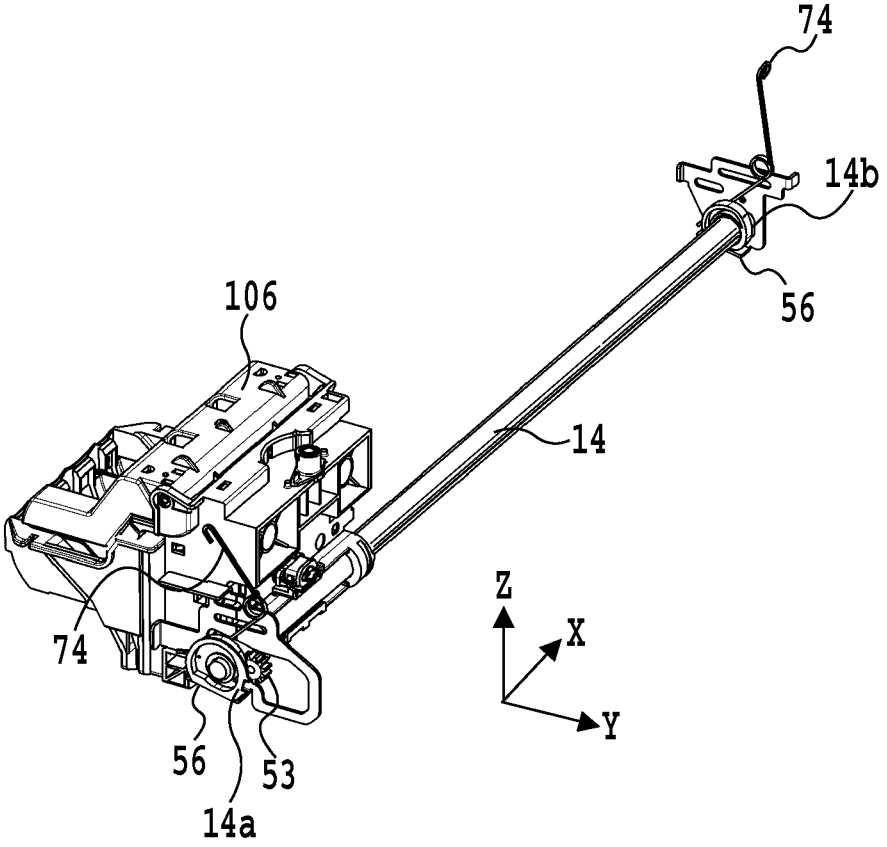
FIG. 3 is a schematic perspective view showing a head-to-platen distance adjusting mechanism used in an embodiment to adjust a distance between a printing head and a printing medium.

FIG. 3 is a configuration example of a head-to-platen distance adjusting mechanism used in this embodiment. This embodiment shows the head-to-platen distance adjusting mechanism in which the guide shaft 14, which is supported by side walls (not shown) formed on both side plates in the main scanning direction in FIG. 1, and which is extended in the main scanning direction to support the carriage 106, can be elevated and lowered to thereby move up and down the carriage.

In FIG. 3, reference numeral 14*a* denotes a guide shaft cam attached to one side end of the guide shaft 14, and reference numeral 14*b* denotes also a guide shaft cam attached to the other side end thereof. Reference numeral 53 denotes a cam idler gear that connects a lift cam gear 52 to a gear integrally provided on the guide shaft cam 14*a*. The guide shaft 14 is supported by a chassis, which is not shown, with both end portions fit into guide long holes that are respectively formed on both side plates of the chassis and that extend in a vertical direction. Then, the guide shaft 14 is movable in a direction of an arrow Z (elevating and lowering directions) in FIG. 3, but movement thereof in directions of arrows X and Y is restricted.

The guide shaft 14 is urged in a downward direction (direction opposite to arrow Z) by guide shaft springs 74, and is normally engaged with a lower end portion of each guide long hole. Moreover, when the cam idler gear 53 rotates, the guide shaft cams 14*a* and 14*b* are abutted against guide slopes 56, respectively, and the guide shaft 14 itself is elevated while being rotated. In accordance with this movement, the carriage supported by the guide shaft 14 and the printing head are also elevated.

Figure 4A:
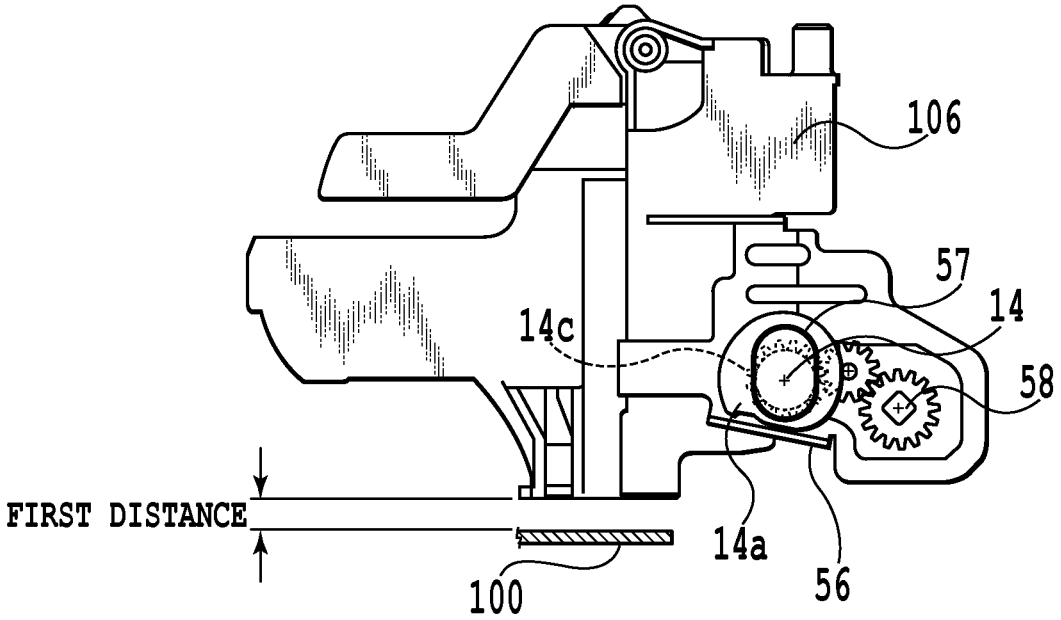
FIGS. 4A and 4B are schematic side views each explaining an operation of the head-to-platen distance adjusting mechanism in FIG. 3.
Figure 4B:
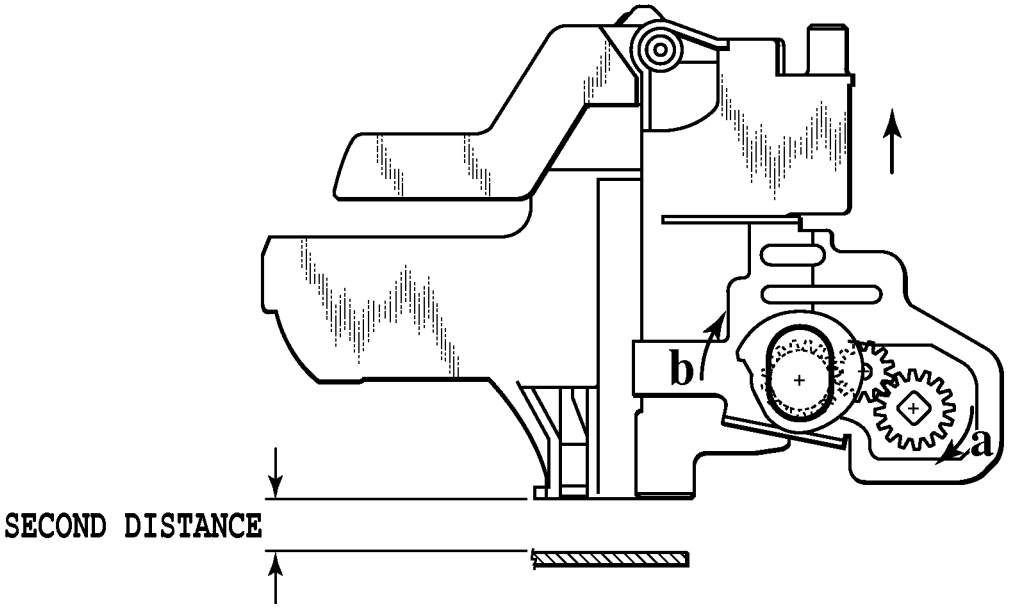

FIGS. 4A and 4B are schematic side views each explaining an operation of the head-to-platen distance adjusting mechanism. In these figures, reference numeral 100 denotes a platen. The platen 100 is provided to a region facing to the ejection faces of the printing head 201 to 204, and supports the printing medium 107 at the backside surface thereof to flatten a printed surface thereof.

FIG. 4A is a view showing a state in which the carriage 106 is placed at a standard position, namely, a first position where the printing heads 201 to 204 and the platen 100 are relatively close to each other and maintain a first distance. In this state, the guide shaft 14 is abutted against and engaged with the lower end portion of the guide long holes 57 of the chassis, and the guide shaft cam 14*a* and the guide slope 56 are not in contact with each other. On the other hand, FIG. 4B is a view showing a state in which the carriage 106 is moved to a position a little higher than the standard position, namely, a second position where printing heads 201 to 204 and the platen 100 are relatively separated from each other and maintain a second distance.

For moving the carriage 106 from the first position to the second position, that is, elevating the carriage 106, a lift cam shaft 58 is rotated. As a result, the lift cam gear 52 fixed to the lift cam shaft 58 is rotated and a guide shaft gear 14*c* is rotated through the cam idler gear 53 meshed with the lift cam gear 52. Consequently, when the lift cam shaft 58 is rotated in a direction of an arrow a, the guide shaft 14 is also rotated in a direction of an arrow b as shown in FIG. 4B. This rotation causes the guide shaft cams 14*a* and 14*b* to be abutted against the fixed guide slopes 56, respectively. Then, when the rotation is further continued, the direction of movement of the guide shaft 14 is restricted to only the vertical direction by the guide long holes 57 of the chassis as mentioned above, and therefore the guide shaft 14 is pushed up in a direction Z by the cams 14*a* and 14*b*, so that movement to the second position is achieved. For moving the carriage 106 from the second position to the first position, that is, lowering the carriage 106, the lift cam shaft 58 may be rotated in a direction opposite to the above.

In this embodiment, two types of distances can be set, and a head-to-platen distance (the first distance) corresponding to the first position and a head-to-platen distance (the second distance) corresponding to the second position can be set to, for example, about 1.3 mm and about 1.9 mm, respectively. However, these values can be appropriately set depending on the type of printing medium to be handled, size, characteristic of ink, and characteristic of the printing apparatus, and such setting is preferable. Additionally, this embodiment has explained the mechanism in which the guide shaft or carriage is elevated and lowered to thereby perform the head-to-platen distance adjustment. However, any mechanism may be used if a relative distance between the platen 100 or the printed surface of the printing medium and the printing head is changeable. For example, a mechanism may be provided to elevate and lower the platen 100 to thereby adjust the head-to-platen distance.

Configuration Example of Control System

Figure 5:
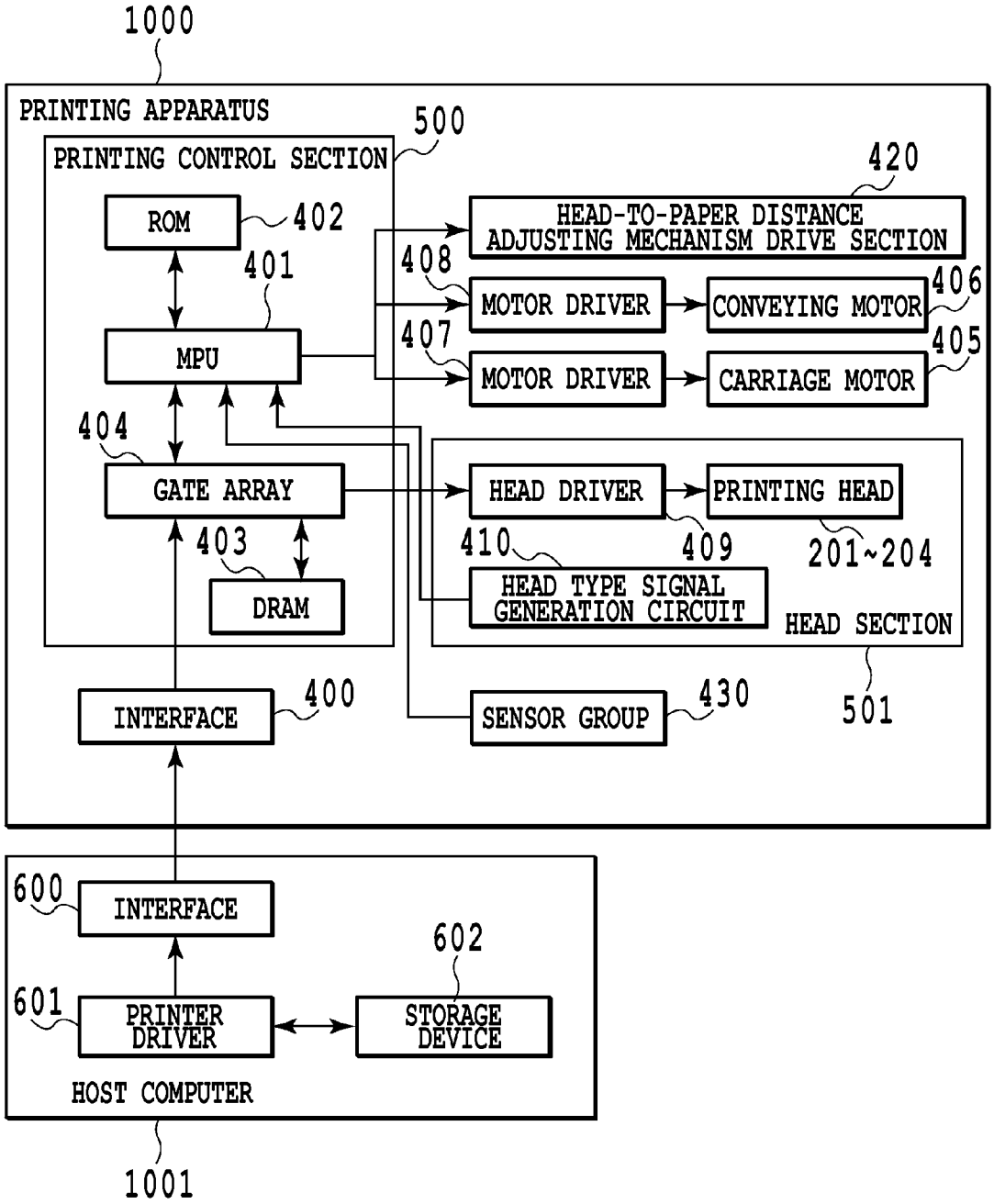
FIG. 5 is a block diagram showing a configuration example of a control system of a printing system for executing control of the printing apparatus in FIG. 1.

FIG. 5 is a configuration example of a control system of a printing system for executing control of the aforementioned inkjet printing apparatus. In FIG. 5, reference numeral 1001 denotes a host computer, serving as an image data supply apparatus that generates print data to be printed by the printing apparatus 1000 and inputs instructions of various types. Reference numeral 601 denotes a printer driver, which displays a setting screen for instructions of various types relating to printing, and which generates print data according to a set value on the setting screen. Reference numeral 602 denotes a storage device that temporarily stores print data generated by the printer driver 601. Further, the storage device 602 stores an operating system (OS) that controls the host computer 1001, control programs of various types, an application program for generating data as a base of print data, or the like. In addition, the host computer 1001 has standard hardware configuration elements to be mounted on the general-purpose computer. Namely, this includes, for example, a CPU, a RAM, a ROM, a hard disc, an external storage device, a network interface, a display, a keyboard, a mouse, etc.

An interface 600 of the host computer 1001 is connected to an interface 400 of the printing apparatus 1000 and transmits print data and a control signal relating to printing. Further, the host computer 1001 receives information such as a status of the printing apparatus from the printing apparatus 1000, and displays the information as required.

In the printing apparatus 1000, reference numeral 401 denotes an MPU that executes a control program corresponding to a processing procedure to be described later. Reference numeral 402 denotes a ROM that stores the control program executed by the MPU 401 and other fixed data. Reference numeral 403 denotes a dynamic RAM (DRAM) that stores data of various types (print signals supplied to the printing heads 201 to 204, a control signal for printing, or the like). Reference numeral 404 denotes a gate array that performs control over supply of print data to the printing heads 201 to 204, and also performs control over data transfer among the interface 400, the MPU 401, and the DRAM 403. A control section 500 of the printing apparatus 1000 is configured as mentioned above.

Moreover, in the printing apparatus 1000, reference numeral 405 denotes a carriage motor serving as a drive source for moving the carriage 106 in the main scanning direction and 406 is a conveying motor serving as a drive source for conveying the printing medium 107 in the sub-scanning direction. Reference numerals 407 and 408 denote motor drivers that drive the carriage motor 405 and the conveying motor 406, respectively.

Reference numeral 409 denotes a head driver that drives each of the printing heads 201 to 204 and a plurality of head drivers is provided to correspond to the number of printing heads. Moreover, reference numeral 410 denotes a head type signal generation circuit that notifies the MPU 401 of information of the type and the number of the printing heads 201 to 204 mounted on a head section 501. Further, reference numeral 420 denotes a drive section of the head-to-platen distance adjusting mechanism explained in FIGS. 3, 4A and 4B, and specifically includes a motor that drives the mechanism for elevating and lowering the guide shaft 14 or carriage 106. Reference numeral 430 denotes a sensor group that includes a position sensor such as a photocoupler for detecting a home position, and a temperature sensor or humidity sensor provided at an appropriate position of the printing apparatus to detect an environmental condition.

First Example of Print Controlling

In this embodiment, it is made possible to select whether to execute processing (image discrimination function) for issuing an instruction to set the number of print passes and a head-to-platen distance according to discrimination of the content of the image. Then, when execution of the image discrimination function is selected, either "print method 1" or "print method 2" (to be described later) is executed according to the content of the image, and when it is not selected, "print method 3" is executed regardless of the content of the image. Specifically, when execution of the image discrimination function is selected, a combination of the number of print passes corresponding to "print method 1" or "print method 2" and a head-to-platen distance is set according to the content of the discriminated image. On the other hand, when execution of the image discrimination function is not selected, a combination of the predetermined number of print passes corresponding to "print method 3" and a predetermined head-to-platen distance is set.

Figure 6:
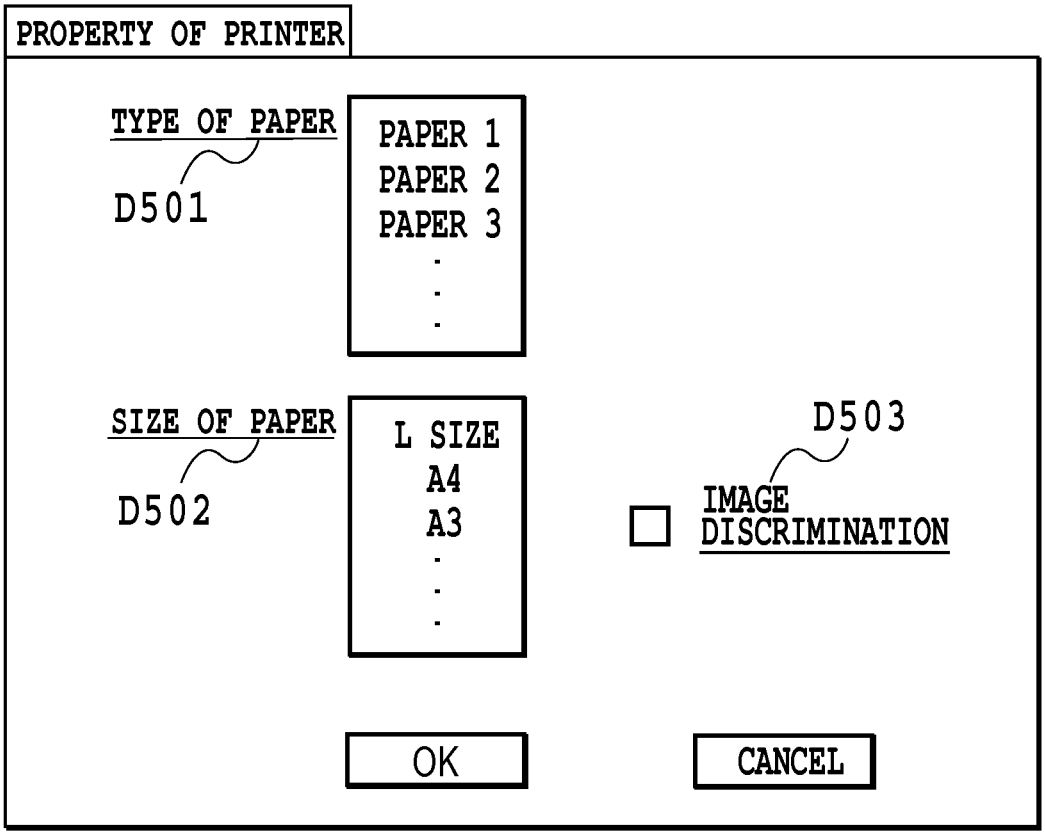
FIG. 6 is a schematic view of a setting screen presented to a user when printing is performed in the printing system in FIG. 5.

FIG. 6 is a schematic view of a setting screen presented to a user when printing is performed using the inkjet printing apparatus 1000. This can be shown as a setting screen of the printer driver 601 operated in the host computer 1001. This example of the setting screen has a portion D501 where the type of printing medium (paper) is specified, a portion D502 where the size of printing medium is selected, and a portion D503 where execution of the image discrimination function is instructed by marking a checkbox. Then, when a user performs selection setting and instructs printing, the following control is executed.

Figure 7:
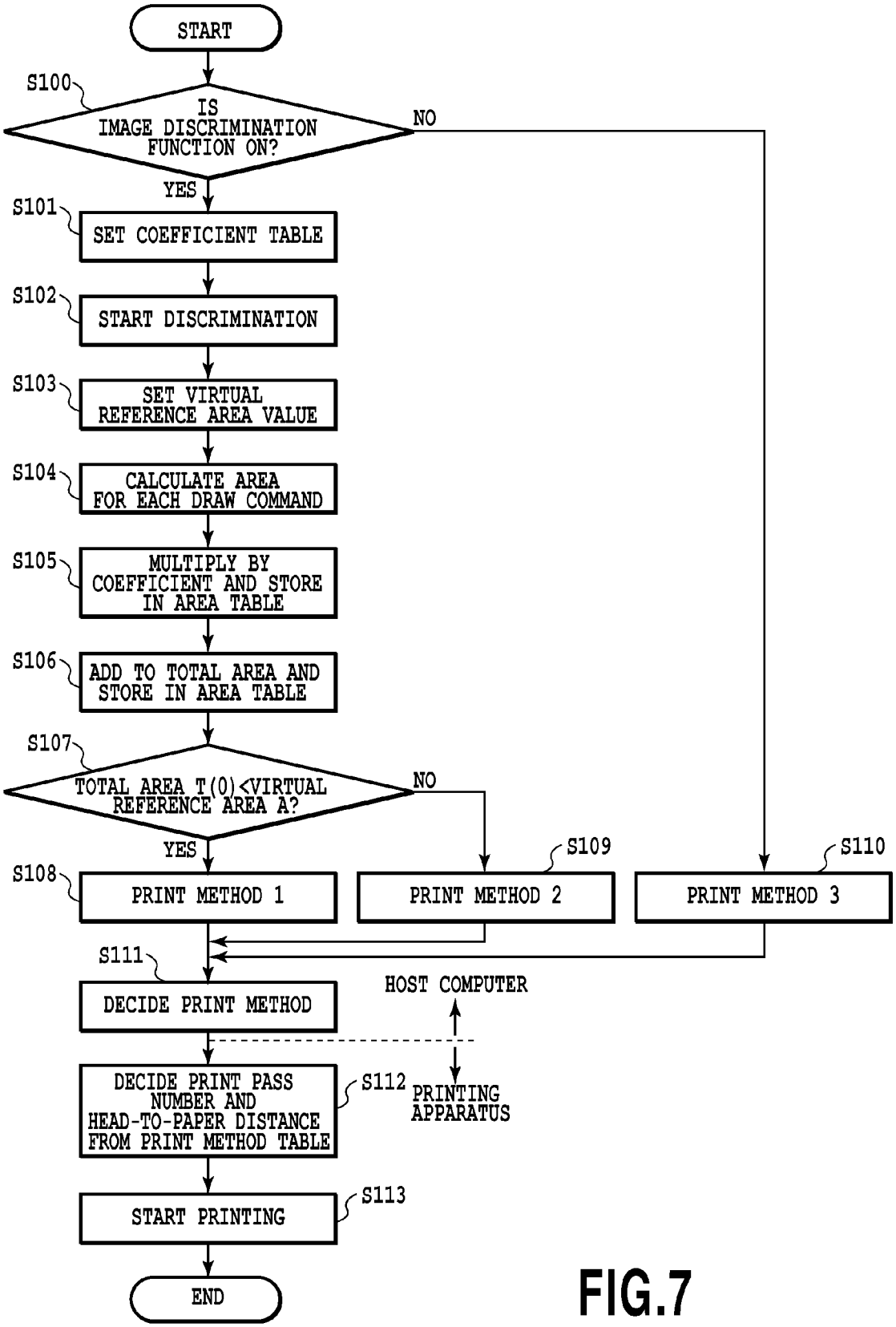
FIG. 7 is a flowchart showing an example of a control procedure to be executed by the printing system in FIG. 5.

FIG. 7 shows an example of a control procedure executed by a printing system of the present embodiment, that is, the host computer 1001 and the printing apparatus 1000. It should be noted that, in the following procedure, processing up to decision of the print method (step S111) is executed by the host computer 1001 and the processing that follows is executed by the printing apparatus 1000.

When this procedure is started, it is determined whether or not the image discrimination function is selected (ON) at step S100). If affirmative, processing goes to step S101 to perform image discrimination processing, and either "print method 1" or "print method 2" is selected based on the result of the image discrimination processing. On other hand, when the determination at step S100 is negative, "print method 3" is immediately selected as a print method (step S110).

When the image discrimination function is ON, in step S101 a coefficient table, which is composed of coefficients for calculating a virtual drawing area for print data to be printed, is set. In this case, the "virtual drawing area" represents a drawing area obtained by multiplying an area of a drawing region for drawing a significant image to be drawn according to a draw command in print data by a coefficient based on the type of the draw command. Here, the coefficient is a value indicating weight where the area of the drawing region is used as a basis for determination when the print method of print data is decided.

In the coefficient table, for example, when print data is text data (character, numeral, mark, and the like), black is mainly used as a print color and the drawing area for each character is not so large, and therefore the coefficient is set to 0% since there is no need to increase print quality. On the other hand, when print data is image data other than the text data, the drawing area is expected to be large, and therefore the coefficient is set to 100% or more since it is desirable that printing be performed with high possible quality.

FIG. 8 shows a configuration example of a coefficient table that is set. Here, the coefficient for "draw command 1" is set to K[1] and the coefficient for "draw command 2" is set to K[2], and the coefficient for "draw command n" is set to K[n] as a generalization. It should be noted that n represents a number corresponding to each draw command appearing in print data as in 1, 2, 3, . . . n.

Specifically, when OS is, for example, "Windows (registered trademark) 2000" and "DrvTextOut" as a text draw command is present in print data, the coefficient is set to 0%. On the other hand, when the draw command includes "DrvStretchBlt" as one of image draw commands, the coefficient is set to 150%. Thus, the table is provided in which a suitable coefficient is fixed for each draw command on the basis of the content of the draw command.

Figure 9:
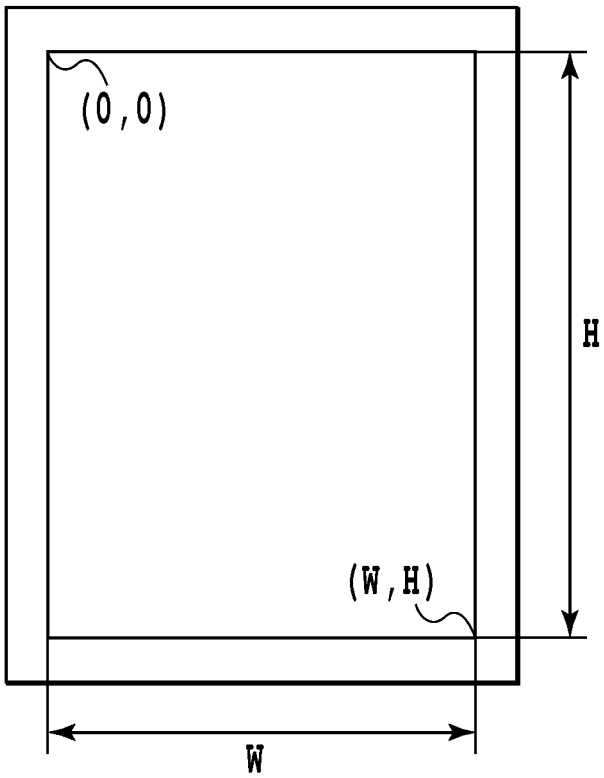
FIG. 9 is an explanatory view explaining a calculation manner of a virtual reference area value to be executed in the procedure in FIG. 7.

Next, discrimination processing is started (step S102). First, a virtual reference area value for a page to be processed is calculated (step S103). In this case, a reference area ratio is set to P % and a coefficient is set to K[0] in the coefficient table. Regarding the reference area, for example, a printable range (0,0)-(W,H) in FIG. 9 is obtained and a value multiplied by the reference area ratio is set as a virtual reference area value A=K[0]×(W×H).

The operating system sends print data to the printer driver 601 through the draw command. First, the printer driver 601 calculates a drawing area of drawing data sent for each draw command (step S104). Here, it is assumed that an area of rectangular region corresponding to the drawing area of drawing data to be processed is simply used as a drawing area. Here, the drawing region is a region ensured to develop a significant image (for example, text and image) in drawing data, and is used as, for example, a circumscribed rectangular region of the significant image and a rectangular region that encloses the significant image.

Figure 10:
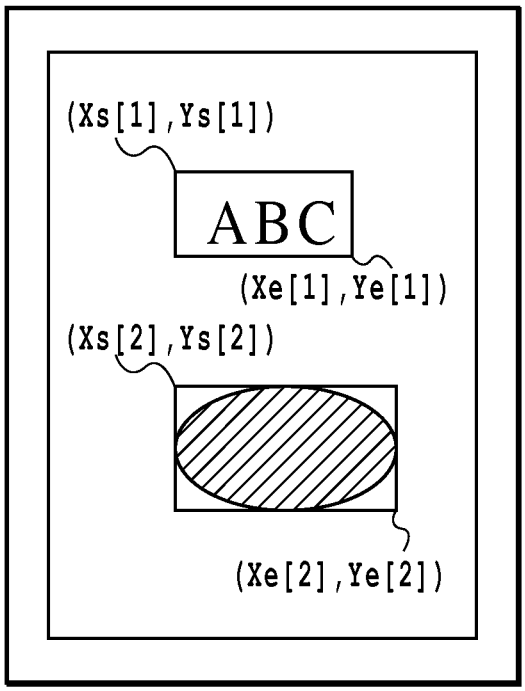
FIG. 10 is an explanatory view showing an example of an image to be printed.

For example, if drawing data of a drawing region (Xs[1], Ys[1])–(Xe[1], Ye[1]) is sent in response to "draw command 1" as shown in FIG. 10, the following equation is established.

$$\text{Drawing area } S[1]=(Xe[1]-Xs[1])\times(Ye[1]-Ys[1]).$$

Moreover, if drawing data of a drawing region (Xs[2], Ys[2])–(Xe[2], Ye[2]) is sent in response to "draw command 2", the following equation is established.

$$\text{Drawing area } S[2]=(Xe[2]-Xs[2])\times(Ye[2]-Ys[2]).$$

Likewise, if drawing data of a drawing region (Xs[n], Ys[n])–(Xe[n], Ye[n]) is sent in response to "draw command n", the following equation is established.

$$\text{Drawing area } S[n]=(Xe[n]-Xs[n])\times(Ye[n]-Ys[n]).$$

Next, the virtual drawing area obtained by multiplying the drawing area calculated for each draw command by a coefficient value (which is read from the coefficient table set before printing) of a corresponding draw command is added to the area table for each draw command (step S105).

If the area table is set to T as shown in FIG. 11, S[1]×K[1] is added to the area table T[1] in response to "draw command 1" and the following equation is established.

$$T[1]=T[1]+S[1]\times K[1]$$

Further, S[2]×K[2] is added to the area table T[2] in response to "draw command 2" and the following equation is established.

$$T[2]=T[2]+S[2]\times K[2]$$

Likewise, S[n]×K[n] is added to the area table T [n] in response to "draw command n" and the following equation is established.

$$T[n]=T[n]+S[n]\times K[n]$$

Then, the total area of all virtual drawing areas is stored in the area table (step S106). For example, if T[0] of the area table T is used as a storage location of the total area of the virtual drawing areas, processing is made based on the following equation.

$$T[0]=T[0]+S[1]\times K[1]+S[2]\times K[2] \ldots S[n]\times K[n]$$

A total value of the virtual drawing areas each obtained for each draw command in print data for one page is compared with a predetermined value, and a print method for the print data is decided based on the comparison result. In other words, when all of print data for one page are sent to the printer driver 601, it is determined whether or not the total area T[0] of all virtual drawing areas is smaller than a virtual reference area value A (step S107). Namely, it is determined whether the duty of the image is higher or lower than a threshold value.

When the determination is affirmative, that is, T[0]<A, it is determined that there is a high possibility that the page is composed of drawing data having a low duty, and therefore "print method 1" is selected (step S108). On the other hand, when the determination is negative, that is, T[0]≥A, it is determined that there is a high possibility that the page will be composed of drawing data, which has a high duty and which is suitable for printing in multi-pass mode, and therefore "print method 2", whose number of print passes is larger than that of "print method 1", is selected.

The print method is decided through the aforementioned processing (step S111). Namely, any one of "print method 1", "print method 2" and "print method 3" is selected.

The printer driver 600 performs the aforementioned selection processing and generates print data interpretable by the printing apparatus 1000. The print data is transmitted to the printing apparatus 1000 through the interfaces 600 and 400 together with selection information of the print method and other required control data.

The printing apparatus 1000 decides the number of passes and a head-to-platen distance corresponding to the selected print method with reference to a print method table prestored in, for example, a ROM 402 (step S112).

FIG. 12 shows an example of a print method table that the printing apparatus has. Here, when "print method 1" is selected, an image having a relatively low duty is assumed, and therefore setting is made such that the number of print passes is one in which an image is completed by one-time print scan and the head-to-platen distance is 1.3 mm (first position, first distance). Moreover, in the case of "print method 2", setting is made such that the number of print passes is two in which an image is completed by two-time print scans and the head-to-platen distance is 1.9 mm (second position, second distance). Namely, when "print method 2" is selected, an image having a relatively high duty is assumed, and therefore the number of passes is large and the head-to-platen distance is also large compared with "print method 1." Further, in the case of "print method 3" where the image discrimination function is OFF, setting is made such that the number of print passes is one and the head-to-platen distance is 1.9 mm (second position, second distance). Namely, in the case of "print method 3", one-pass print is set regardless of the duty of the image to make it possible to perform printing with high productivity for a short period of time. Furthermore, the head-to-platen distance is made larger to prevent occurrence of contact between the printing medium and the printing head due to cockling even when an image with any duty is printed. In other words, this embodiment performs processing completely opposite to that of the configuration disclosed in Japanese Patent Laid-Open No. 2002-292856, and this considers not only the content of the image but also a print manner that the user desires, that is, user's request of putting emphasis on speed to improve productivity.

Finally, printing is executed based on the above-decided number of print passes and head-to-platen distance (step S113).

As mentioned above, according to this embodiment, the number of times of print scans (the number of print passes) and the head-to-platen distance are set according to the selection result of whether or not discrimination processing for discriminating the content of the image to be printed is performed (namely, whether or not the image discrimination function is ON). Specifically, when discrimination processing is selected, the number of times of print scans (one pass or two passes) and the head-to-platen distance (first distance or second distance) are set according to the content of the image discriminated by discrimination processing. On the other hand, when no discrimination processing is selected, a predetermined number of times of print scans (one pass) and a predetermined head-to-platen distance (second distance) are set.

The above-explained configuration enables to set the optimal number of print passes and head-to-platen distance in response to the content of the image to be printed and the user's request, thereby making it possible to appropriately meet the needs for higher image quality and higher productivity and to perform printing with high reliability.

Though this embodiment has shown the configuration in which only one print method table is provided, a table may be provided for each type of the printing medium so as to make it possible to appropriately set the number of passes and the head-to-platen distance depending on the type of printing medium. Moreover, in the case where the user can select print quality such as "fine (high quality print)", "normal", "fast (high speed print)", a table may be provided for each type of print quality. Or, a combination of these tables may be configured.

In this embodiment, although the same number of print passes is selected in "print method 1" and "print method 3", it may be, of course, possible to set the number of passes differently for each method. In the above example, the number of passes is set to two types including one pass and two passes. However, the number of settable passes may be three or more types according to the value of the image duty of three or more levels or in view of the relationship between the type of the printing medium and the print quality, in the case where selection from more print methods is possible. The same can be applied to the head-to-platen distance. In the above example, the head-to-platen distance can be set to two levels; however, this may be set to three or more levels. In the case of a configuration in which the head-to-platen distance can be set to three or more levels, the head-to-platen distance is made different for each of "print method 2" and "print method 3."

For example, the head-to-platen distances, which correspond to "print method 1", "print method 2", "print method 3" respectively, are set as "first distance", "second distance" and "third distance", respectively. In this case, it is preferable that "third distance" be larger than "second distance."

Although this example has shown the case in which both the number of print passes and the head-to-platen distance are set according to the selection result of whether or not image discrimination processing is performed, a configuration in which only the head-to-platen distance is set may be used. In this case, when the image discrimination function is ON, a head-to-platen distance (for example, first distance or second distance) is set according to the content of the image, and when the image discrimination function is OFF, a predetermined head-to-platen distance (for example, second distance) is set. In addition, the number of print passes may be decided according to other parameters such as the type of printing medium, print quality, etc.

Second Example of Print Control

The following will explain an embodiment, as a second example of print control, that changes the head-to-platen distance depending on environmental conditions (temperature, humidity) under which the printing apparatus is placed in addition to the configuration of the first example.

In this example, a print method table is prepared in advance for each environmental condition, and a table to be referenced is changed based on information of temperature or humidity obtained from a temperature and humanity sensor provided in the sensor group 430.

FIGS. 13A and 13B show print method tables each provided for each environmental condition according to this embodiment. For the purpose of simplification, explanation for this embodiment will be given in terms of only two environmental conditions, that is, "environmental condition A" and "environmental condition B." For example, a case where temperature ranges from 15° C. to 30° C. and humidity ranges from 40% to 60% is defined as "environmental condition A", and a case where temperature ranges from 15° C. to 30° C. and humidity ranges from 10% to 40% is defined as "environmental condition B." Regarding the other temperature and humidity conditions, explanation will be omitted.

FIG. 13A shows a print method table in the case of "environmental condition A," and FIG. 13B shows a print method table in the case of "environmental condition B." Then, for example, when temperature 20° C. and humidity is 50% in reading the print method table in step S112 in FIG. 7, this corresponds to "environmental condition A", and therefore, in this case, the print method table shown in FIG. 13A is referred to decide the number of print passes and head-to-platen distance.

Regarding the temperature condition, "environmental condition A" and "environmental condition B" are the same, but regarding the humidity condition, the latter is the lower humidity side. Here, a cockling phenomenon remarkably occurs in the case of the low humidity environment. For this reason, in order to avoid contact between the printing medium and the printing head due to cockling, the head-to-platen distance in the table in FIG. 13B is set so as to be larger than that in the table in FIG. 13A.

As mentioned above, according to the configuration of this embodiment, in addition to the effect of the first example, the print condition is changed based on the environmental condition to thereby make it possible to deal with the environmental variation appropriately.

In addition, this embodiment has shown the tables that change only the head-to-platen distance on the basis of the environmental condition. However, it may be possible to use a configuration that changes only the number of print passes or a configuration that changes both on the basis of the environmental condition. Namely, setting may be made so as to change at least one of the number of print passes and the head-to-platen distance if it is possible to effectively avoid contact between the printing medium and the printing head regardless of degree of the cockling phenomenon due to the environmental condition.

Others

The aforementioned embodiment has shown the configuration in which duty as the content of the image is discriminated from the total value of multiplication values (virtual drawing areas) of coefficients, which are based on different types of draw commands contained in print data described in an OS control language, and drawing areas, thereby to allow selection of a print method on the basis of a high or low value of the duty. However, it may be possible to directly select the print method on the basis of the draw command contained in the print data. Namely, the print method can be selected from the rate of text draw command contained in print data and the rate of image draw command or a distribution state thereof.

Moreover, the discrimination of the duty of the image is not limited to the aforementioned example. For example, the print driver 601 converts print data described in the OS control language into bit data to perform color conversion processing and further converts the bit data into print data corresponding to the configuration of the printing apparatus. In this case, the discrimination of the duty of the image may be performed based on the relevant conversion process or converted data.

In any case, when processing is carried out by a host computer, the processing is realized by a program such as an application software or printer driver. That is, the processing is realized such that program codes of the application software or printer driver are supplied to a system or apparatus and executed by the computer (or CPU or MPU) of the system or apparatus.

In this case, the program codes themselves provide a novel feature of the invention. Accordingly, the program codes themselves and a unit for supplying the program codes to the computer by means of communication or a storage medium so as to activate the computer based on the program codes stored therein are also included in the scope of the invention. As the storage medium for supplying the program codes, for example, a hard disk, an optical disk, a magneto-optical disk, a CD-R, a DVD, a magnetic tape, a non-volatile memory card, or a ROM may be used as well as a flexible disk or a CD-ROM.

In addition, the function of the foregoing embodiments can be realized not only in the case where the computer executes retrieved program code, but also in the case where an OS operated in the computer carried out a part or all of an actual processing on the basis of the command from the program code. Such a system is also encompassed within the scope of the present invention.

Furthermore, the function of the foregoing embodiments can be realized by using a system in which the retrieved program codes are written on a memory provided in a function expanding board inserted into the computer or a memory provided in a function expanding unit connected to the computer, and then a part of or all of processes are executed by the CPU or the like provided in the function expanding board or the function expanding unit on the basis of the command from the program code. Such a system is also encompassed within the scope of the present invention.

Still furthermore, as the form of the printing system of the present invention, it is possible to adopt a form of, for example, a copying machine in combination with a reader or the like, and a facsimile having receiving and transmitting functions, besides the above mentioned form in which a printing apparatus is combined with an external device such as a host computer.

In addition, selection whether or not to execute the image discrimination function or selection setting of the print method corresponding thereto may be carried out by the inkjet printing apparatus. As a selection unit for selecting whether or not to execute the image discrimination function, an operation section prepared in the printing apparatus can be used. Moreover, in setting selection of the print method, it may be possible to perform discrimination processing for discriminating the content of the image (duty) on the basis of print data that are supplied. In these cases, the inkjet printing apparatus as a single unit embodies one form of the present invention.

In addition, the form of the printing apparatus may be not only a so-called serial type as mentioned above but also a so-called line printer form where printing elements are arrayed over the range corresponding to the whole width of the printing medium.

Moreover, it is needless to say that the material of the printing medium is not limited to paper, and the present invention can effectively applied to any material if swelling as a problem might occur.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application No. 2007-184497, filed Jul. 13, 2007, which is hereby incorporated by reference herein in its entirety.

What is claimed is:

1. A printing apparatus that performs an operation for moving a printing head for ejecting ink to a printing medium and an operation for conveying the printing medium in a direction intersecting a direction of movement of the printing head to thereby print an image on the same region on the printing medium, the printing apparatus comprising:

a platen that supports the printing medium conveyed;

an acquiring unit that acquires information as to whether or not to execute a discrimination of the image to be printed;

a discriminating unit that discriminates the image when the acquiring unit acquires information to execute discrimination; and a setting unit that sets a number of the movement of the printing head and a distance between the printing head and the platen according to the result of the discrimination of the image discriminated by the discriminating unit when the acquiring unit acquires information to execute discrimination and sets a combination of a predetermined number of movement of the printing head and a predetermined distance regardless of the image when the acquiring unit acquires information to not execute discrimination.

2. The printing apparatus as claimed in claim 1, wherein the setting unit sets at least one of the number of the movement of the printing head and the distance according to an environmental condition.

3. The printing apparatus as claimed in claim 1, further comprising a selection unit that selects whether or not to execute discrimination.

4. A control method for a printing system including the printing apparatus according to claim 1 and a supply apparatus that supplies data of an image to be printed by the printing apparatus, the method comprising the steps of:

performing discrimination; and selecting whether or not to execute the discrimination.

5. The printing apparatus as claimed in claim 1, wherein the discriminating unit discriminates a duty of the image and the setting unit sets a first distance between the printing head and the platen when a first duty is discriminated and sets a second distance longer than the first distance between the printing head and the platen when a second duty higher than the first duty is discriminated when the acquiring unit acquires information to execute discrimination.

6. The printing apparatus as claimed in claim 5, wherein the setting unit sets the distance between the printing head and the platen to be the same as the second distance when the acquiring unit acquires information to not execute discrimination.

7. The printing apparatus as claimed in claim 1, wherein the discriminating unit discriminates a duty of the image, and the setting unit sets a first number of movement when a first duty is discriminated and sets a second number of movement larger than the first number of movement when a second duty higher than the first duty is discriminated, when the acquiring unit acquires information to execute discrimination.

8. The printing apparatus as claimed in claim 7, wherein the setting unit sets the number of movement to be the same as the first number of movement, when the acquiring unit acquires information to not execute discrimination.

9. A printing apparatus that performs an operation for moving a printing head for ejecting ink to a printing medium and an operation for conveying the printing medium in a direction intersecting a direction of movement of the printing head to thereby print an image on the same region on the printing medium, the printing apparatus comprising:

a platen that supports the printing medium conveyed;

discriminating unit discriminating a number of the movement of print head suitable for image on the same region from image data corresponding to the image in case there is a direction which perform the discriminating; and a setting unit that sets a first distance between the printing head and the platen when a first number of movement is discriminated, sets the first distance longer than a second distance between the printing head and the platen when the first number of movement is bigger than a second number of movement that is discriminated when discrimination is performed, and sets a combination of a predetermined number of movement of the printing head and a predetermined distance regardless of the image data when discrimination is not performed.

10. A printing method that processes an operation for moving a printing head for ejecting ink to a printing medium and an operation for conveying the printing medium in a direction intersecting a direction of movement of the printing head to thereby print an image on the same region on the printing medium, the printing method comprising the steps of:

supporting the printing medium to be conveyed by a platen;

acquiring information as to whether or not to execute a discrimination;

discriminating a duty of an image when information to execute discrimination is acquired; and setting a number of the movement of the printing head and a distance between the printing head and the platen according to the duty of the image when information to execute discrimination is acquired and setting a combination of a predetermined number of movement of the printing head and a predetermined distance regardless of the duty of the image when information to not execute discrimination is acquired.

11. The printing method as claimed in claim 10, wherein in the setting step, at least one of the number of the movement of the printing head and the distance is set according to an environmental condition.

12. The printing method as claimed in claim 10, further comprising the step of selecting whether or not to execute discrimination.

13. A control method for a printing system including the printing method according to claim 10 and a supply apparatus that supplies data of an image to be printed by the printing method, the control method comprising the steps of:

performing discrimination; and selecting whether or not to execute the discrimination.

14. The printing method as claimed in claim 10, wherein in the discriminating step, a duty of the image is discriminated, and in the setting step, a first distance between the printing head and the platen is set when a first duty is discriminated and a second distance longer than the first distance between the printing head and the platen is set when a second duty higher than the first duty is discriminated, when in the acquiring step, information to execute discrimination is acquired.

15. The printing method as claimed in claim 14, wherein in the setting step, the distance between the printing head and the platen is set to be the same as the second distance, when in the acquiring step, information to not execute discrimination is acquired.

16. The printing method as claimed in claim 10, wherein in the discriminating step, a duty of the image is discriminated, and a first number of movement is set when a first duty is discriminated and a second number of movement larger than the first number of movement is set when a second duty higher than the first duty is discriminated, when in the acquiring step, information to execute discrimination is acquired.

17. The printing method as claimed in claim 16, wherein in the setting step, the number of movement is set to be the same as the first number of movement, when in the acquiring step, information to not execute discrimination is acquired.

* * * * *